US008789775B2

(12) United States Patent
Fursattel et al.

(10) Patent No.: US 8,789,775 B2
(45) Date of Patent: Jul. 29, 2014

(54) METHOD FOR REFINING AQUEOUS SUSPENDED CELLULOSE FIBERS AND REFINER FILLINGS FOR CARRYING OUT SAID METHOD

(75) Inventors: Markus Fursattel, Ravensburg (DE); Tillman Katzenmeier, Ravensburg (DE); Hans-Hermann Kleinschnittger, Weingarten (DE)

(73) Assignee: Voith Patent GmbH, Heidenheim (DE)

( * ) Notice: Subject to any disclaimer, the term of this patent is extended or adjusted under 35 U.S.C. 154(b) by 175 days.

(21) Appl. No.: 13/109,307

(22) Filed: May 17, 2011

(65) Prior Publication Data

US 2011/0278385 A1 Nov. 17, 2011

Related U.S. Application Data

(63) Continuation of application No. PCT/EP2009/063564, filed on Oct. 16, 2009.

(30) Foreign Application Priority Data

Nov. 28, 2008 (DE) ..... 10 2008 059 610

(51) Int. Cl.
*B02C 11/08* (2006.01)
*B02C 21/00* (2006.01)
*B02C 23/00* (2006.01)

(52) U.S. Cl.
USPC ..... 241/21; 241/261.2; 241/261.3

(58) Field of Classification Search
USPC ..... 241/21, 261.2, 261.3
See application file for complete search history.

(56) References Cited

U.S. PATENT DOCUMENTS

| | | | | |
|---|---|---|---|---|
| 2,921,749 | A | 1/1960 | Brink et al. | |
| 4,423,845 | A * | 1/1984 | Frazier et al. | 241/261.3 |
| 4,712,745 | A | 12/1987 | Leith | |
| 5,112,443 | A * | 5/1992 | Virving et al. | 162/23 |
| 5,178,339 | A | 1/1993 | Pilao | |
| 5,439,183 | A | 8/1995 | Virving | |
| 5,893,525 | A * | 4/1999 | Gingras | 241/298 |
| 5,954,283 | A * | 9/1999 | Matthew | 241/298 |
| 6,325,308 | B1 * | 12/2001 | Lofgren et al. | 241/28 |
| 6,607,153 | B1 * | 8/2003 | Gingras | 241/261.3 |
| 7,419,112 | B2 * | 9/2008 | Sjostrom et al. | 241/298 |

(Continued)

FOREIGN PATENT DOCUMENTS

| | | | |
|---|---|---|---|
| CA | 2493678 | A1 * | 7/2005 |
| DE | 20 2005 007 551 | U1 | 7/2005 |

(Continued)

OTHER PUBLICATIONS

International Search Report for PCT/EP2009/063564, dated Mar. 18, 2011 (5 pgs).

*Primary Examiner* — Gena Miller
(74) *Attorney, Agent, or Firm* — Taylor IP, P.C.

(57) ABSTRACT

A method for refining aqueous suspended cellulose fibers including the step of guiding the fibers in an aqueous suspension between refiner fillings. The refiner fillings are provided with refining strips and interposed grooves and are located either on a rotor or a stator. The refiner fillings are caused to be rotatably moved relative to each other and pressed against each other, thereby transmitting mechanical a refining action to the cellulose fibers. The refiner fillings include barriers in at least part of the grooves, the barriers closing the grooves at least partially.

37 Claims, 3 Drawing Sheets

(56) References Cited

U.S. PATENT DOCUMENTS

| | | | | |
|---|---|---|---|---|
| 7,913,942 | B2 * | 3/2011 | Vuorio | 241/261.2 |
| 8,226,023 | B2 * | 7/2012 | Vuorio et al. | 241/261.3 |
| 2002/0185560 | A1 | 12/2002 | Johansson | |
| 2005/0247808 | A1 * | 11/2005 | Huhtanen et al. | 241/261.1 |
| 2007/0210197 | A1 | 9/2007 | Carpenter | |
| 2010/0314476 | A1 * | 12/2010 | Vuorio | 241/101.2 |

FOREIGN PATENT DOCUMENTS

| | | | |
|---|---|---|---|
| EP | 1088932 | A2 | 4/2001 |
| FR | 1298656 | | 6/1962 |
| WO | 2009/068739 | A1 | 6/2009 |

* cited by examiner

METHOD FOR REFINING AQUEOUS SUSPENDED CELLULOSE FIBERS AND REFINER FILLINGS FOR CARRYING OUT SAID METHOD

CROSS REFERENCE TO RELATED APPLICATIONS

This is a continuation of PCT application No. PCT/EP2009/063564, entitled "METHOD FOR REFINING AQUEOUS SUSPENDED CELLULOSE FIBERS AND REFINER FILLINGS FOR CARRYING OUT SAID METHOD", filed Oct. 16, 2009, which is incorporated herein by reference.

BACKGROUND OF THE INVENTION

1. Field of the Invention

The present invention relates to a method for refining aqueous suspended cellulose fibers.

2. Description of the Related Art

It is known that cellulose fibers, that is virgin cellulose or waste paper fibers, are introduced into a suspension which is capable of being pumped and are then refined. This alters the individual fibers to such an extent that the paper which is subsequently created from them possesses the desired properties, especially strength, formation and surface. Refining methods of the type considered here utilize refining tools which are equipped with refining strips which are referred to as blades. The relevant machinery is generally referred to as refiners. The refining tools are known as refiner fillings.

Refiner fillings for refining cellulose fibers utilizing refining strips and interposed grooves are known, for example, from DE 20 2005 007 551 U1.

What is needed in the art is a method for cellulose refining which would provide economic and particularly uniform refining, in other words one in which the desired technological refining changes are as uniform as possible on all fibers.

SUMMARY OF THE INVENTION

The present invention provides a method for refining an aqueous suspension of cellulose fibers and refiner fillings used to carry out the method.

More specifically, the present invention provides a method for refining an aqueous suspension of cellulose fibers by guiding the aqueous fiber suspension between refiner fillings on a rotor or a stator. The refiner fillings include a number of refining strips positioned with interposed grooves. At least part of these refiner fillings include barriers in at least part of the grooves. The barriers at least partially close the grooves. The described refiner fillings are moved rotating relative to one another and pressed against one another to transmit a mechanical refining action.

According to the method of the present invention, it is possible to positively influence the flows of the fibrous suspension in and between the refiner fillings. The grooves which are interposed between the refining strips are to be viewed as flow channels for the suspension. With disk and cone refiners it can be assumed that, due to the rotational movement of the rotor and the thereby transported fibrous suspension, a more or less strong pressure build up occurs from radially inside areas to the radially outside areas. Because of this pressure differential a backflow of the suspension occurs in the non-rotating grooves, in other words between the blades of the stator—at least in sections—from radially outside to radially inside. On the path which is traveled by the back-flowing suspension inside one groove, a transfer can occur from the open side of the groove to the opposite refiner filling. The inventive barriers promote the exit of the suspension from the grooves which are interposed between the refining strips, into the refining zone, in other words to the mating blade edges. This repeat of the refining action renders the refining more uniform which is of particular advantage, both technologically and from an energy efficiency point of view.

An additional advantage of the present invention is that, with the assistance of the barriers, the danger of transporting the suspension too quickly through the grooves of the rotor fillings can be reduced or eliminated, which otherwise would lead to a lesser level of refining and to unnecessary energy consumption.

Essentially the aforementioned barriers may be utilized with the stator fillings, as well as with those of the rotor, or with both. The plurality of grooves have a radial extension extending between a radial innermost edge and a radial outermost edge of the grooves. The barriers may be located at a radial distance from the innermost edge of the grooves, the radial distance being at most approximately 50%, for example at most 30%, of the radial extension of the grooves.

The barriers may also be located at a radial distance from the innermost edge of the grooves, the radial distance being at least approximately 50% of the radial extension of the grooves, for example at least 70% of the radial extension of the grooves.

The barriers may also be located at a radial distance from the innermost edge of the grooves, the radial distance being at least approximately 50%, for example 70%, of the radial extension of the grooves.

Where the refiner fillings, including the barriers, are on both the rotor and the stator, the grooves on the rotor have a radial extension extending between a radial outermost edge and a radial innermost edge of the grooves. The barriers located on the rotor in this case are positioned at a first radial distance from the radial innermost edge of the grooves on the rotor, the first radial distance being at most 50%, for example at most 30%, of the radial extension of the grooves on the rotor. In addition, the barriers on the stator are positioned at a second radial distance from the radial innermost edge of the stator, the second radial distance being at least approximately 50%, for example at least 70%, of the radial extension of the grooves on the stator.

Alternatively, according to another embodiment, the second radial distance, that is the radial distance of the barriers from the radial innermost edge of the grooves on the rotor, is at least approximately 50%, for example at least 70%, of the radial extension of the grooves of the rotor. In addition, first radial distance, that is the distance of the barriers from the radial innermost edge of the grooves on the stator, is at most approximately 50%, for example at most 30%, of the radial extension of the grooves of the stator. The first radial distance differs by at least approximately 10%, for example at least 30%, from each other.

Refining methods of this type are conducted at a temperature below approximately 100° C., in other words without consequential steam production and typically at a consistency between approximately 2% and 8%. In many instances, a refiner filling for processes of this kind is designed so that as many blades as possible can be accommodated on it, for example in order to optimize the refining effect by lowering the specific edge load. The flow channels relative to such refining processes which work with such fillings are particularly effectively improved by the present invention. Advantageously, the fillings are equipped with refining strips with straight refining edges, which can also progress discontinuously, in other words which may have break points.

The present invention further provides a refiner filling for refining an aqueous suspension of cellulose fibers, including a plurality of refining strips with a interposed grooves between the refining strips at least part of the grooves include barriers which at lest partially close the grooves.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
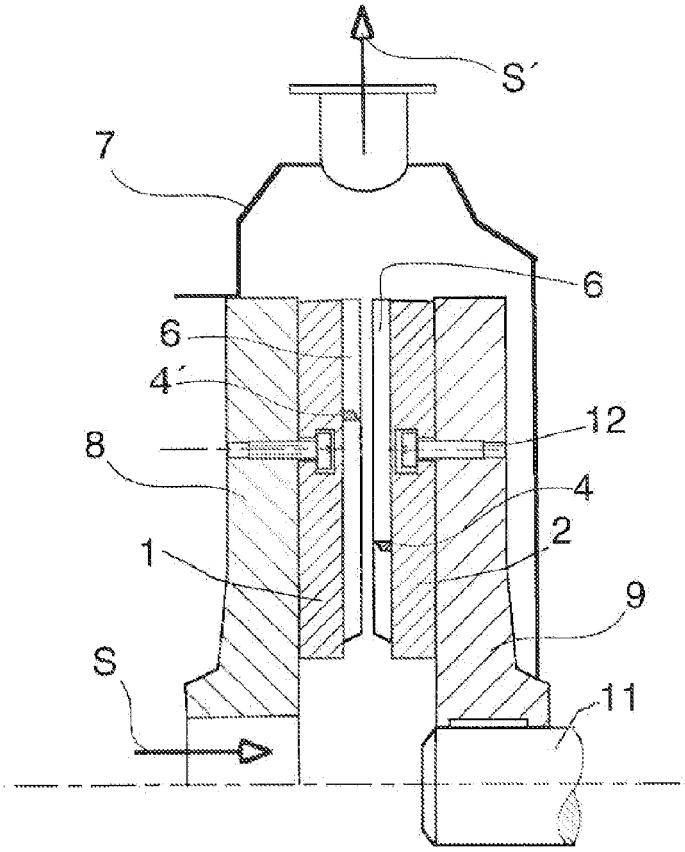
FIG. 1 illustrates implementation of the method according to the present invention with a disk refiner.

Referring now to the drawings, and more particularly to FIG. 1, there is shown that the method according to the present invention may be implemented in a refining device, which is, schematically illustrated in a cross sectional view. A set of refiner fillings 1 is mounted on stator 8 and a set of refiner fillings 2 is mounted on rotor 9, detachable by means of screws 12. Refiner fillings 1 and 2 are blade fillings which are equipped with refining strips 6, a top view of which can be seen, for example, in FIGS. 2 and 3. In the illustrated example, suspension S, which is to be refined, passes through the center of stator 8 into refiner fillings 1 and 2. This illustration strongly exaggerates the axial distance that refiner fillings 1 and 2 are located from each other. In actual operation it amounts to only a fraction of millimeters. Suspension S passes conspiring refiner fillings 1 and 2, emerges again on the outlet side, collects in annulus 7 and at least partially leaves annulus 7 via an appropriate connection pipe, in the form of refined suspension S'.

Rotor 9 is driven by shaft 11. Generally known means with which power is generated to press the two refiner fillings against each other are not illustrated.

In the example illustrated here, barriers 4 and 4' are located in grooves 3 on stator 8, as well as rotor 9, providing the already described effect. The arrangement is explained in examples depicted in FIGS. 2 and 3.

Grooves 3, having groove widths N, are arranged over a refining surface of refiner fillings 1 and 2. In one embodiment of the present inventions, groove depth t of grooves 3 interposed between refiner strips 6 have a constant groove width N over at least approximately 80% of the refining surface with a tolerance between approximately −10% and +10%. Over at least approximately 80% of the refining surface groove depth t of grooves 3 is between approximately 3 millimeters (mm) and 20 mm, for example between approximately 3 mm and 10 mm. Further, over at least 80% of the refining surface, refining strips 6 have a constant blade width with a tolerance between approximately −10% and +10%. In an area of barrier 4, the blade width may be, for example, at least approximately 1 mm and at most approximately 30 mm, or at most approximately 5 mm.

Figure 2:
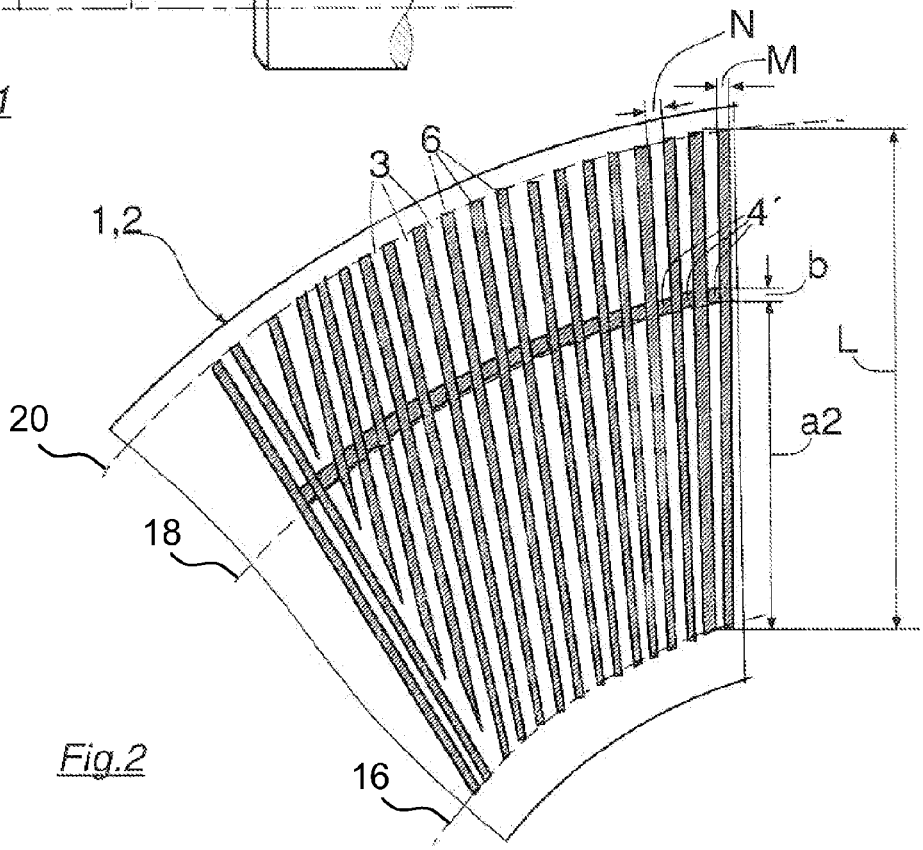
FIGS. 2 and 3 are top views of a respective section of a refiner filling for use in accordance with the present invention.

According to FIG. 2, barrier 4' is provided in each groove 3 of refiner filling 1 allocated to stator 8. Its radial extension b may be short—for example between approximately 5 to 30 mm. Here, barriers 4' are located at radial distance a2 from the radial innermost edge of the grooves which is represented by line 16 and which amounts to at least approximately 70%, for example at least 50%, of radial extension L of grooves 3. Radial extension of grooves 3, as show in FIG. 2, is the distance between the radial inmost edge 16 of grooves 3 and a radial outmost edge 20. In the case of refiner filling 2 which is provided for rotor 9 it is different (see FIG. 3). Here, barriers 4 are located at a radial distance a1 measured from a radial inmost edge 18 of barriers 4 to the radial innermost edge 16 of the grooves 3 and which amounts to at most approximately 30%, for example at most 50%, of radial extension L of grooves 3. Through this arrangement the suspension flowing in grooves 3 of rotor 9 is pushed relatively early from the grooves equipped with barriers 4 in the direction of stator 8, and refined.

As already mentioned, after having emerged, part of the suspension flows back at the radial outer edge of the rotor fillings, more precisely through grooves 3, having a groove width N, which are interposed between refining strips 6 in stator 8. The backflow is slowed by barriers 4' on the stator side and the suspension is again directed into the refining area between conspiring refiner fillings. In the barrier 4' arrangement described above this transfer occurs relatively early on, for example on the first third of the flow path in the stator groove.

Figure 3:
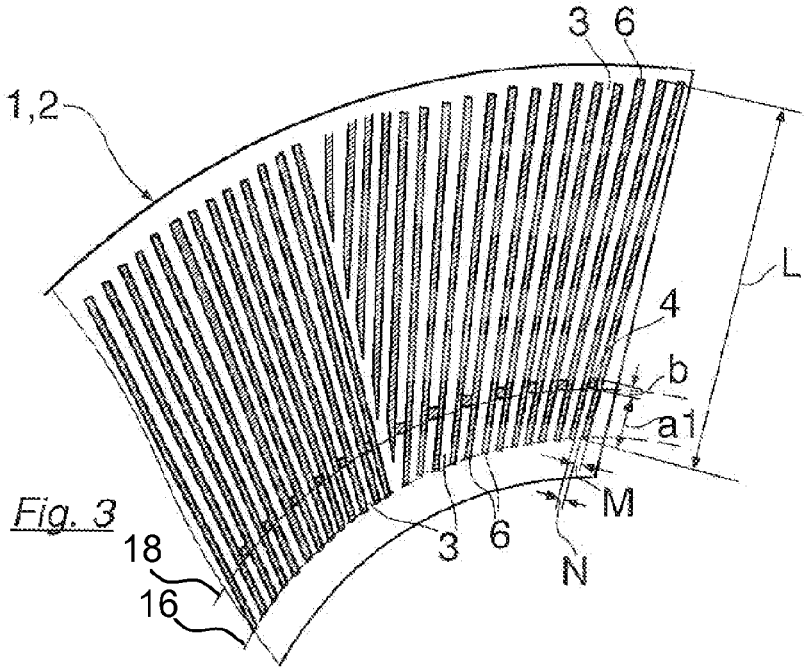
Figure 4:
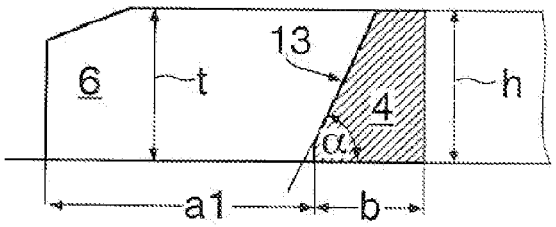
FIGS. 4-8 illustrate variations in shapes and sizes of barriers according to the present inventions.
Figure 5:
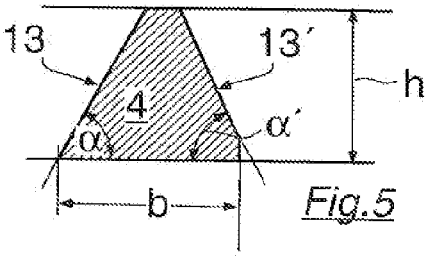
Figure 6:
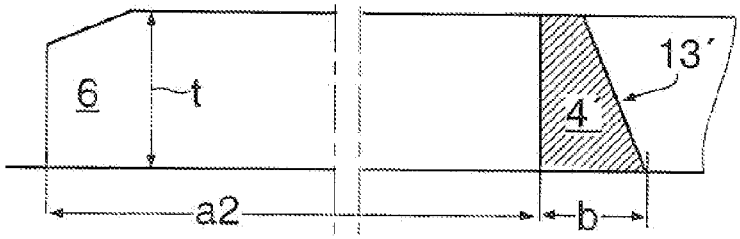

The refiner filling illustrated in FIG. 2 is typically used on stator 8 with barriers 4' located further outside and the one illustrated in FIG. 3 on rotor 9 with barriers 4 located further inside, which is also consistent with the principle illustrated in FIG. 1. It is, however, also conceivable that the barriers are positioned the other way around, for example if it is found to be advantageous if the backflow in the grooves of the stator filling, and the flow in the grooves of the rotor filling make contact with a barrier relatively late.

Depending on the desired effect, every groove 3 may be equipped with barrier 4 or 4', or only some of them, for example every second, third or fourth groove. FIG. 3 shows an example where every second groove is equipped with barrier 4.

For the most part, grooves 3 are equipped with just one barrier 4 or 4', whereby the distance a1 or a2 from the radial innermost edge of grooves 3 on all barriers 4 or 4' respectively of the same refiner filling may be the same. Distances a1 and a2 of conspiring refiner fillings which move relative to each other (rotor/stator) clearly differ, for example by at least approximately 10%, for example, by at least 30%.

Figure 9:
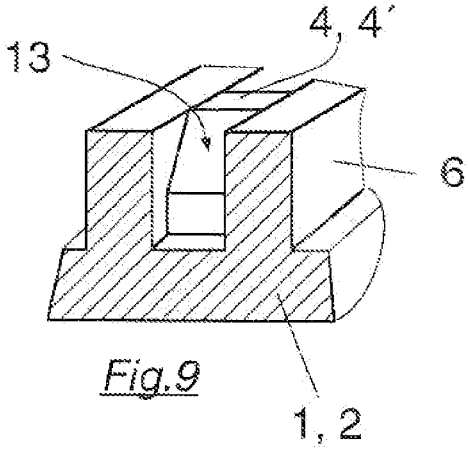
FIG. 9 is an exploded view of a barrier according to the present invention.

If wear and tear is very high in the area of the barriers, neighboring barriers in a refiner filling may be axially offset in order to distribute the wear over a greater area. FIG. 9 shows an example of this arrangement. This aspect needs to be weighed against the requirement of achieving uniform refining which can more likely be expected with distances a1 and a2 being uniform.

It is also possible to provide the grooves with several barriers respectively, for example with fillings having great groove lengths.

Figure 7:
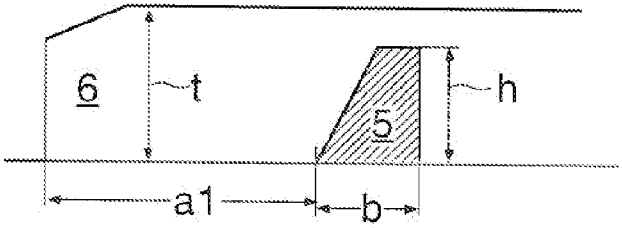
Figure 8:
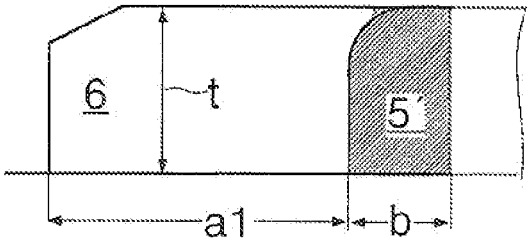

Referring now to FIGS. 4, 5, 7 and 8, it is shown that barriers 4 or 4' can have height h which is equal to groove depth t, so that it extends to the refining edges of refining strips 6, having a width M. In contrast FIG. 7 shows barrier 5 with height h of only approximately 80% of groove depth t which, therefore, closes only part of the groove. Even such a low barrier 5 can, however, be hydraulically effective. Height h of the barriers above the bottom of grooves 3 may have a value between approximately 30% and 100%, for example between approximately 50% and 80%, of groove depth t. Height h of the barriers may also be consistent with groove depth t. Each groove may include a maximum of two, for example 1 barrier. The refining strips include a plurality of straight refining edges. The refining edges progress discontinuously and include at least one break point.

Each of FIGS. 4, 5, 6, 7 and 9 show embodiments of the present invention whereby the flow carrying surfaces of barriers 4, 4' and 5 are beveled in order to achieve an improved flow control at this location. Barriers 4, 4' and 5 may have at least one bevel over at least approximately 50% of the height h of the barriers. Beveling 13 or 13' of this type extends, for example, over approximately 80% of height h of the barrier. Angle of inclination $\alpha$ or $\alpha'$ respectively is at least approximately 15 degrees, for example between approximately 45 and 89 degrees. A similar effect can possibly also be achieved with a rounding off on the inflow side according to FIG. 8. Rounding off or beveling can be applied on one or both sides of the barriers, as is shown in an example in FIG. 5. Rounding off or beveling can be applied on both sides of the barriers with refiner fillings which are used on the stator side the flow conditions can thus be further improved. Beveling 13 or 13' may be located on a radial inner side of respective barriers of at least one refiner filling of the stator. Beveling 13 or 13' may further be located on a radial outer side of barriers of at least one refiner filling of the stator. Also shown in FIG. 9 is an arrangement of refiner fillings in which at least a portion of the barriers of the refiner fillings are located adjacent to each other and at a distance from a rotation axis of the which is the same. Alternatively, or in addition to this arrangement the refiner fillings are offset from each other in a radial direction, as illustrated in FIG. 10.

Figure 10:
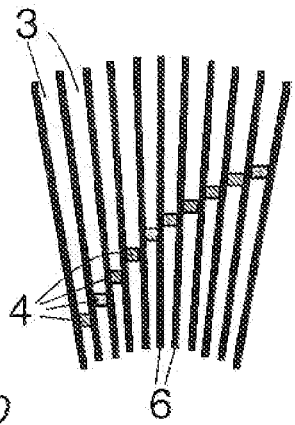
FIG. 10 is a filling section with axially offset barriers according to the present invention.

Referring now to FIG. 10, there is illustrated a filling section with axially offset barriers. The refiner fillings, more specifically, the barriers of the refiner fillings may be located adjacent to each other and at a distance from a rotational axis that is the same.

Figure 11:
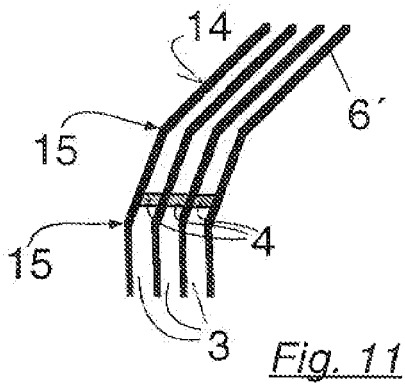
FIG. 11 is a filling section with break points on refining edges according to the present invention.

Refiner edges 14 can be straight which simplifies manufacture of the fillings and is favorable from a flow technological point. As shown in FIG. 11, one or more break points 15 can change the angle to the radius, for example when a favorable angle of intersection of the refiner edges making contact with each other of conspiring refiner fillings (rotor 9 with stator 8) is produced.

The method according to the present invention can also be designed so that in addition to or in combination with the measures described above, the flow cross section in grooves 3 may be changed by different groove depth t. Groove depth t therefore may increase or decrease from the inside to the outside, such that groove depth t on the stator may be increased and groove depth t on the rotor may be decreased. This too influences the backflow in the grooves, especially the transfer of the suspension flowing back in the grooves into the refiner zone.

Figure 12:
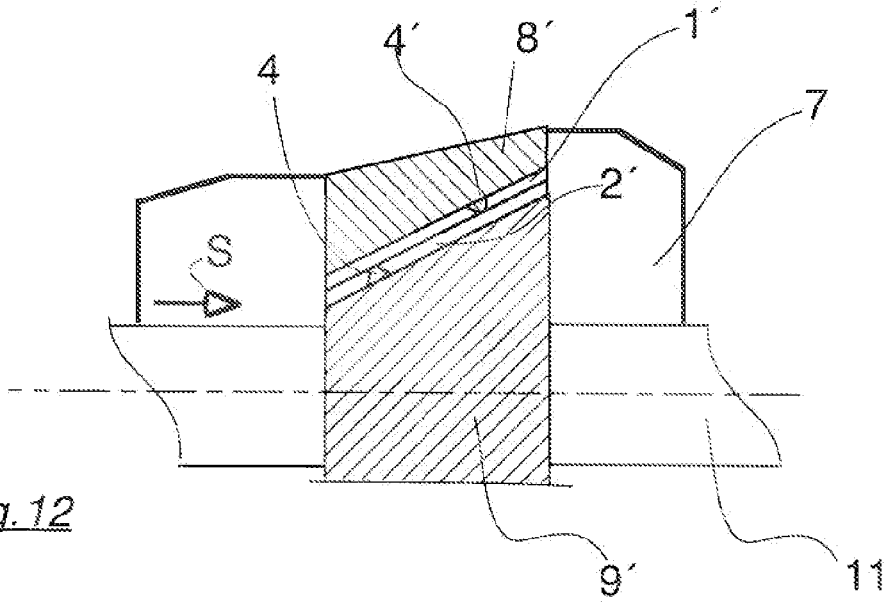
FIG. 12 illustrates implementation of the method according to the present invention with a cone refiner.

Referring now to FIG. 12, there is shown a cone refiner with which the method of the present invention may be practiced. More specifically, there is shown female taper stator 8 supporting fillings 1' and concentric male taper rotor 9 with refiner fillings 2'. Further descriptions of these machines are not necessary here since cone refiners are known in the art. Barriers 4, 4' are located between the grooves on the stator, as well as on the rotor side whereby the aforementioned with regard to disk-shaped refiner fillings in respect to number, shape and layout can be assumed.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of refining an aqueous suspension of cellulose fibers, the method comprising the steps of:

guiding the fibers in the aqueous suspension between a plurality of refiner fillings located on at least one of a rotor and a stator, said refiner fillings including a plurality of refining strips and a plurality of interposed grooves, at least a portion of said refiner fillings including a plurality of barriers in at least a portion of said grooves, said barriers at least partially closing said portion of said grooves and a depth of said grooves one of increasing and decreasing toward an outside of said at least one of said rotor and said stator;

causing said refiner fillings to be moved rotating relative to one another and pressed against one another to transmit a mechanical refining action to the cellulose fibers.

2. The method according to claim 1, wherein at least a portion of the aqueous suspension of cellulose fibers flowing in said plurality of grooves emerges from said grooves through said plurality of barriers.

3. The method according to claim 2, wherein said plurality of grooves have a radial extension extending between a radial innermost edge of said grooves and a radial outermost edge of said grooves, said barriers being located at a radial distance from said radial innermost edge of said grooves, said radial distance being at most approximately 50% of said radial extension of said grooves.

4. The method according to claim 3, wherein said radial distance is at most approximately 30% of said radial extension of said grooves.

5. The method according to claim 2, wherein said plurality of grooves have a radial extension extending between a radial innermost edge of said grooves and a radial outermost edge of said grooves, said barriers being located at a radial distance from said radial innermost edge of said grooves, said radial distance being at least approximately 50% of said radial extension of said grooves.

6. The method according to claim 5, wherein said radial distance is at least approximately 70% of said radial extension of said grooves.

7. The method according to claim 1, wherein said plurality of refiner fillings including said barriers are on said rotor.

8. The method according to claim 7, wherein said plurality of refiner fillings including said barriers are only on said rotor.

9. The method according to claim 7, wherein said plurality of refiner fillings including said barriers are on said stator.

10. The method according to claim 9, wherein said refiner fillings including said barriers are on said rotor and said stator, said grooves on said rotor having a radial extension extending between a radial outermost edge of said grooves of said stator and a radial innermost edge of said grooves of said rotor, said barriers located on said rotor being positioned at a first radial distance from a radial innermost edge of said grooves on said rotor, said first radial distance being at most approximately 50% of said radial extension of said grooves on said rotor, and said grooves on said stator having a radial extension extending between a radial outermost edge of said grooves of said stator and a radial innermost edge of said grooves of said stator, said barriers located on said stator being positioned at said second radial distance from said radial innermost edge of said grooves of said stator, said second radial distance being at least approximately 50% of said radial extension of said grooves of said stator.

11. The method according to claim 1, wherein said first radial distance is at most approximately 30% of said radial extension of said grooves of said rotor and said second radial distance is at least approximately 70% of said radial extension of said grooves of said stator.

12. The method according to claim 9, wherein said refiner fillings including said barriers are on said rotor and said stator, said barriers located on said rotor are positioned at a second radial distance from said radial innermost edge of said grooves on said rotor, said second radial distance being at least approximately 50% of said radial extension of said grooves of said rotor and said barriers located on said stator are positioned at a first radial distance from said radial innermost edge of said grooves of said stator, said first radial distance being at most approximately 50% of said radial extension of said grooves of said stator.

13. The method according to claim 12, wherein said second radial distance is at least approximately 70% of said radial extension of said grooves of said rotor said first radial distance is at most approximately 30% of said radial extension of said grooves of said stator.

14. The method according to claim 13, wherein said first radial distance and said second radial distance differ by at least approximately 10% from each other.

15. The method according to claim 14, wherein said first radial distance and said second radial distance differ by at least approximately 30% from each other.

16. The method according to claim 15, wherein at least a first portion of said barriers of a set of said refiner fillings are located adjacent to each other and at a distance from a rotational axis of said rotor that is the same.

17. The method according to claim 16, wherein at least a second portion of said barriers of said set of said refiner fillings are offset from each other in a radial direction.

18. The method according to claim 17, wherein said refining strips include a plurality of straight refining edges.

19. The method according to claim 18, wherein said refining edges progress discontinuously and include at least one break point.

20. The method according to claim 19, wherein over at least approximately 80% of a refining surface said refiner filling, said grooves interposed between said refining strips have a constant groove width with a tolerance between approximately −10% and +10%.

21. The method according to claim 20, wherein over at least approximately 80% of said refining surface said groove depth of said grooves interposed between said refining strips is between approximately 3 millimeters (mm) and 20 mm.

22. The method according to claim 21, wherein over at least approximately 80% of said refining surface said groove depth of said grooves interposed between said refining strips is between approximately 3 mm and 10 mm.

23. The method according to claim 22, wherein over at least approximately 80% of said refining surface, said refining strips have a constant blade width with a tolerance between approximately −10% and +10%.

24. The method according to claim 23, wherein at least in an area of said barriers said blade width is at least approximately 1 mm and at most approximately 30 mm.

25. The method according to claim 24, wherein in said area of said barriers said blade width is at most approximately 5 mm.

26. The method according to claim 25, wherein said barriers have at least one bevel over at least approximately 50% of a height of said barriers, said at least one bevel having an angle of inclination relative to a bottom of said respective groove of at least approximately 15 degrees.

27. The method according to claim 26, wherein said at least one bevel is at least approximately 80% of said height of said barriers and said angle of inclination is at least approximately 45 degrees.

28. The method according to claim 27, wherein said bevel is located on a radial inner side of said respective barriers of said at least one refiner filling of said stator.

29. The method according to claim 28, wherein said bevel is located on a radial outer side of said barriers of said at least one refiner filling of said stator.

30. The method according to claim 29, wherein said barriers include said bevel on each side of said barriers.

31. The method according to claim 30, wherein said height above said bottom of said grooves of at least some of said barriers has a value between approximately 30% and 100% of said groove depth.

32. The method according to claim 31, wherein said height above said bottom of said grooves of at least some of said barriers has a value between approximately 50% and 80% of said groove depth.

33. The method according to claim 32, wherein said height of at least some of said barriers above said bottom of said grooves is consistent with said groove depth.

34. The method according to claim 33, wherein each of said grooves includes a maximum of two of said barriers.

35. The method according to claim 33, wherein each of said grooves includes only one of said barriers.

36. The method according to claim 35, wherein only one of every second groove, every third groove, every fourth groove and every fifth groove includes one of said barriers.

37. A method of refining an aqueous suspension of cellulose fibers, the method comprising the steps of:

guiding the fibers in the aqueous suspension between a plurality of refiner fillings located on a rotor and a stator, said refiner fillings including a plurality of refining strips and a plurality of interposed grooves, said grooves on said rotor including a plurality of barriers, said barriers of said rotor being positioned in at least a portion of said grooves on said rotor, said grooves on said rotor having a radial extension extending between an innermost edge of said grooves on said rotor and an outermost edge of said grooves on said rotor, said barriers on said rotor being positioned at a distance from said innermost edge of said grooves of said rotor, said distance being at most 50% of said radial extension of said grooves of said rotor, said barriers at least partially closing said portion of said grooves, said barriers on said rotor, said barriers of said stator being positioned in at least a portion of said grooves on said stator, said grooves on said stator having a radial extension extending between an innermost edge of said grooves on said stator and an outermost edge of said grooves on said stator, said barriers on said stator being positioned at a distance from said innermost edge of said grooves on said stator, said barriers on said stator being positioned at a distance from said innermost edge of said grooves on said stator which is at least 50% of said radial extension of said grooves on said stator;

causing said refiner fillings to be moved rotating relative to one another and pressed against one another to transmit a mechanical refining action to the cellulose fibers.

* * * * *